United States Patent [19]

Hosokawa et al.

[11] Patent Number: 4,510,610

[45] Date of Patent: Apr. 9, 1985

[54] EXTRACTIVE FURNACE FOR EXTRACTING GASEOUS COMPONENTS FROM MATERIAL SAMPLES

[75] Inventors: Yoshinori Hosokawa; Masahiro Tanimoto; Katsuya Tsuji, all of Kyoto, Japan

[73] Assignee: Horiba, Ltd., Kyoto, Japan

[21] Appl. No.: 541,733

[22] Filed: Oct. 13, 1983

[30] Foreign Application Priority Data

Oct. 30, 1982 [JP] Japan ..... 57-191702

[51] Int. Cl.[3] ..... H05B 3/00

[52] U.S. Cl. ..... 373/118; 219/427

[58] Field of Search ..... 373/116, 117, 118, 125, 373/126; 219/427

[56] References Cited

U.S. PATENT DOCUMENTS 4,388,722 6/1983 Tanimoto ..... 373/118

*Primary Examiner*—A. D. Pellinen
*Assistant Examiner*—Susan Steward
*Attorney, Agent, or Firm*—Wenderoth, Lind & Ponack

[57] ABSTRACT

A furnace for extracting gaseous components from material samples includes upper and lower electrodes mounted to press therebetween a crucible of electrically conductive material. An electric current is applied to the electrodes, thereby causing heating of the material sample contained in the crucible, with the result that gaseous components are extracted from the material sample. At least one of the upper and lower electrodes is rotated about a vertical axis, thereby causing surfaces of the crucible contacting respective surfaces of the upper and lower electrodes to rotate under friction against such respective surfaces, thereby improving electrical contact between the crucible and the electrodes.

7 Claims, 4 Drawing Figures

EXTRACTIVE FURNACE FOR EXTRACTING GASEOUS COMPONENTS FROM MATERIAL SAMPLES

BACKGROUND OF THE INVENTION

The present invention relates to an extraction or extractive furnace for extracting gaseous components from material samples, for example metallic samples or nonmetallic samples such as ceramics, such extracted gaseous components then being analyzed in various known manners. More specifically, the present invention relates to such a furnace whereby a crucible formed of an electrically conductive material, for example a graphite crucible, is positioned between and in electrical contact with an upper electrode and a lower electrode, with an electric current being applied between such electrodes, with the result that the material sample is made molten or is dissolved due to Joule's heat, whereby gaseous components of the material are extracted.

In known furnaces of this general type, the condition of the surfaces of mutual contact between the crucible and the upper and lower electrodes is directly expressed by an electric contact resistance and significantly influences the extractive temperature, and this often may lead to inaccuracy of analysis of the gaseous components. Consequently, it is desired to ensure the best possible electrical contact and the tightest possible contact between the crucible and the electrodes in order to achieve the most accurate possible analysis. However, after conducting a number of extraction operations, the surfaces of the electrodes are exposed to high temperatures and become oxydized, or the various samples splash onto and adhere to the surfaces of the electrodes. This leads to the prevention of a tight and close electrical contact between the material of the electrodes and the crucible.

In the past it has been considered a suitable solution to such problem to polish or clean the surfaces of the electrodes, for example by a mechanical cleaning of the contact surfaces by means of abrasive papers, brushes or the like, before or after an analysis operation. This however is a time consuming and troublesome operation. In addition, there is the possibility that excess polishing or cleaning will lead to a premature deterioration of the contact surfaces of the electrodes.

SUMMARY OF THE INVENTION

With the above discussion in mind, it is the object of the present invention to provide an extractive furnace of the type generally described above, but by which it is possible to avoid and eliminate the above discussed and other prior art disadvantages.

This object is achieved in accordance with the present invention by the provision of an extractive furnace including upper and lower electrodes mounted to press therebetween a crucible of electrically conductive material, such that the application of an electric current to the electrodes will cause heating of a material sample contained in the crucible, thereby extracting gaseous components from the material sample, and means for rotating at least one of the upper and lower electrodes about a vertical axis, thereby causing surfaces of the crucible contacting respective surfaces of the upper and lower electrodes to rotate under friction against such respective surfaces, thereby automatically polishing or cleaning such surfaces and improving the electrical contact between the crucible and the electrodes.

Preferably, the crucible is a graphite crucible.

In one specific embodiment of the present invention, the upper electrode is fixed, and the lower electrode is vertically movable. Specifically, an air cylinder has a movable rod which is connected to the lower electrode, such that movement of the rod selectively raises and lowers the lower electrode.

Furthermore, the respective surfaces of the upper and lower electrodes advantageously comprise a surface defined by a step in the upper electrode and an upper end surface of the lower electrode.

The upper electrode may be non-rotatably mounted, and the rotating means may comprise a rotary actuator connected to the lower electrode to rotate the lower electrode about the vertical axis, whereby only the lower electrode is rotatable. Alternatively, only the upper electrode may be rotatable, or both electrodes may be rotatable, in which case the two electrodes preferably are rotated in opposite directions about the vertical axis.

BRIEF DESCRIPTION OF THE DRAWINGS

The above and other objects, features and advantages of the present invention will become more apparent from the following detailed description, taken with the accompanying drawings, wherein.

DETAILED DESCRIPTION OF THE INVENTION

Figure 1:
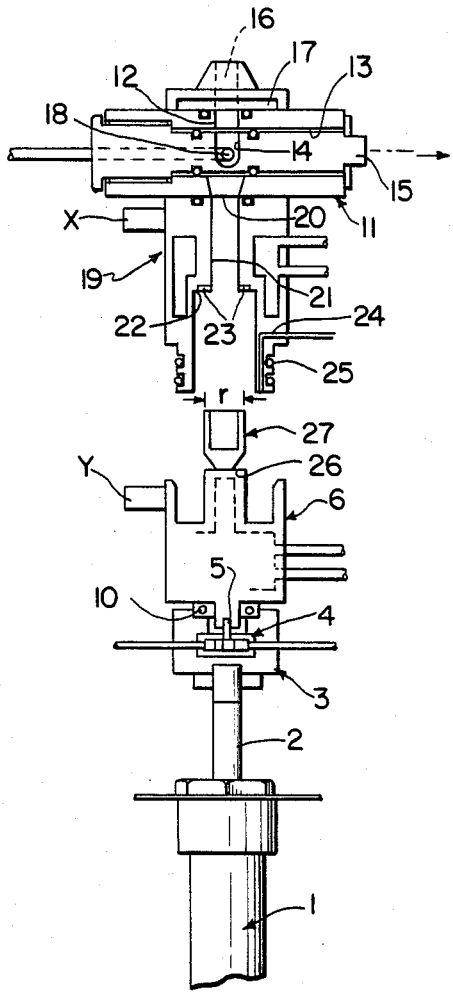
FIG. 1 is a longitudinal view, generally in section, illustrating an extractive furnace of the present invention, and shown in an opened condition.

With reference now to the drawings, a preferred embodiment of the extractive furnace of the present invention includes a piston-cylinder assembly 1, for example an air cylinder, having a vertically movable rod 2 fixed to a lower block 3. A rotary actuator 4 is housed within block 3 and includes an output shaft 5 extending vertically. A lower electrode 6 of an electrically conductive material, for example copper, is fixedly connected to shaft 5.

Figure 3:
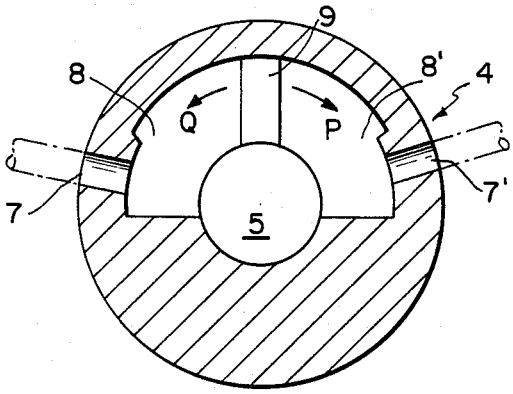
FIG. 3 is an enlarged, generally sectional view showing a rotary actuator in accordance with the furnace of the present invention.

The rotary actuator 4 achieves selective rotation of the lower electrode 6, in a manner which will be apparent from a consideration of FIG. 3. Thus, the rotary actuator includes a body having therein a chamber which is divided into two subchambers 8, 8' by means of a blade or vane 9 fixed to output shaft 5. Two connections 7, 7' extend into respective subchambers 8, 8'. The introduction of a fluid, for example air, through one connection into the respective subchamber will cause movement of blade 9 and rotation of shaft 5 thereby to enlarge such chamber, and to expel fluid from the opposite subchamber. Thus, if air is introduced through connection 7 into subchamber 8, with blade 9 initially being in the midposition, then blade 9 and shaft 5 are rotated approximately 45° in the direction P. On the other hand, if air is introduced through connection 7' into subchamber 8', the blade 9 and shaft 5 rotate in the opposite direction Q by approximately 45°. The supply and discharge of air from the respective subchambers may of course be achieved by any known expedient such as an air passage having a changeover valve. The structure shown in FIG. 3 is just one example of a type of rotary actuator which may be employed in accordance with the present invention. Other devices which achieve the same result, for example rack and pinion devices, similarly may be employed. A suitable bearing 10 is provided between lower electrode 6 and block 3 to absorb the thrust exerted by air cylinder 1.

Figure 2:
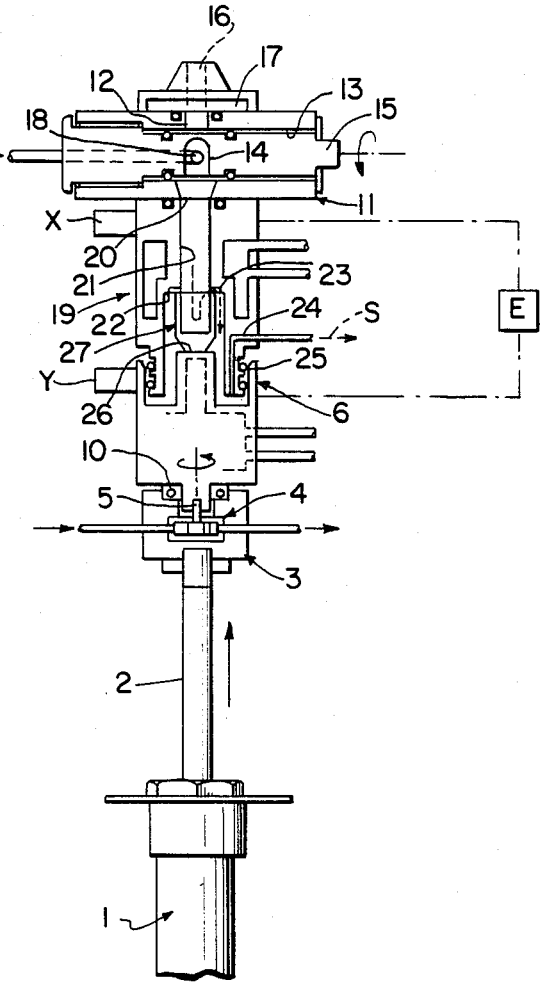
FIG. 2 is a view similar to FIG. 1, but showing the furnace in a closed position, with a crucible being pressed between upper and lower electrodes.

The preferred embodiment of the present invention illustrated in FIGS. 1 and 2 further includes an upper fixed block 11 mounted on a suitable supporting frame (not shown). Block 11 is provided with a vertical bore 12 and a lateral bore 13. A rod 15 is mounted within bore 13 for rotation about the longitudinal axis of rod 15. Rod 15 has provided in a central portion thereof a recess 14 which may be aligned with bore 12. An inlet 16 is provided in alignment with bore 12 for inserting a material sample. Inlet 16 may be selectively opened and closed by means of a shutter 17. A carrier gas inlet 18 extends through the wall of bore 13 and into recess 14 for the supply of a suitable carrier gas, for example an inert gas.

Figure 4:
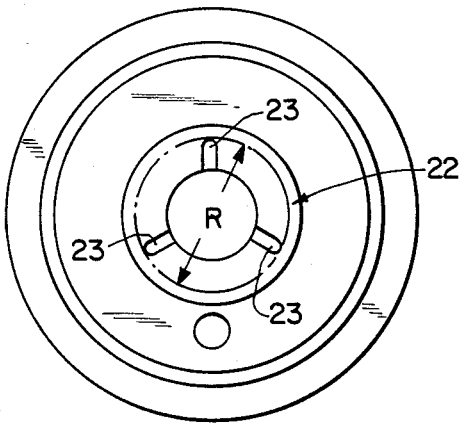
FIG. 4 is an enlarged view from the bottom of FIGS. 1 and 2 of the upper electrode.

Fixed to upper block 11 is an upper electrode 19 formed of a suitable electrically conductive material, for example copper. Upper electrode 19 is provided with a vertically extending bore 21 opening into a lower opening 20 of block 11 which opens into bore 13 and which is vertically aligned with bore 12. Bore 21 is provided with a step portion which defines a generally horizontal surface 22 which has formed therein a plurality, for example three, grooves 23 shown in more detail in FIG. 4. The dimensions of such elements are such that an imaginery circle defined by the outer ends of the three grooves 23 has a diameter R larger than the outside diameter r of a graphite crucible 27, shown in FIG. 1, to be discussed in more detail below. Extending through electrode 19 is an extracted gaseous component exhaust passage 24. Around the exterior of the bottom of electrode 19 are seals 25, for example O-rings, for forming a seal with inner surfaces of a flange of lower electrode 6, thereby sealing a chamber enclosing the crucible when the furnace is in the closed position shown in FIG. 2 of the drawings. It is to be understood that upper and lower electrodes 19, 6 may be provided with conventional cooling means, now shown.

Although it is believed that the operation of the present invention will be apparent from the above, such operation and advantages thereof now will be described.

Firstly, the furnace of the present invention may be employed to test the adequacy of a particular graphite crucible. Thus, with the furnace in the position shown in FIG. 1, a crucible 27 is placed on upper end surface 26 of lower electrode 6. Rod 2 of air cylinder 1 then is raised to move the lower electrode into the closed position shown in FIG. 2, whereat crucible 27 is pressed between the surface 22 of upper electrode 19 and upper end surface 26 of lower electrode 6 at a suitable pressure, for example of approximately 30 kg/cm$^2$. Electic power then is supplied from a suitable electric power source, not shown, to electrodes X, Y on electrodes 19, 6. The resultant indication detected by a volt meter E connected to the two electrodes will determine the electrical resistance of the particular crucible 27. If the value of the electrical resistance of the crucible is within a predetermined range, then an extraction operation is carried out subsequently. If the detected value of the electrical resistance of the crucible is outside of the predetermined range, then lower electrode 2 may be lowered and the unsatisfactory crucible may be removed and destroyed. During this initial testing operation, the electrical current supplied is much lower than that supplied during an operation for extraction of gaseous components. For example, the electrical current supplied during the above discussed testing operation may be one ampere, while the electrical current applied during a gaseous component operation may be approximately 1,000 amperes.

Assuming that a satisfactory crucible is pressed between the upper and lower electrodes, rotary actuator 4 is actuated to first turn shaft 5 and lower electrode 6 in one direction about a vertical axis through shaft 5, in the illustrated embodiment through an angle of approximately 45°. The actuator 4 then may be operated to achieve rotation in the opposite direction by an amount of approximately 45° from the original center position. During such operation, the crucible 27 is tightly held between the upper and lower electrodes. Since the lower electrode is rotated, frictional relative movement occurs between the surfaces 22 and 26 and the respective surfaces of crucible 27. This creates an automatic self-polishing of such electrode surfaces and ensures smooth and satisfactory electrical contact between the electrode surfaces and the crucible.

Thereafter, with the rod 15 being in the position shown in FIG. 1, shutter 17 is opened and a material sample, for example a metallic sample, is inserted through inlet 16 into recess 14. Rod 15 then is turned by 180° to the position shown in FIG. 2, whereby the sample passes from recess 14 through bore 21 into crucible 27. A large electrical current then is applied to terminals X, Y, thereby causing the metallic sample in the crucible to become molten due to Joule's heat generated the high current passing through the graphite crucible 27. At the same time, a carrier gas is fed through inlet 18. As a result, gaseous components are extracted from the metallic sample, and the carrier gas passes through bore 21 and carries the gaseous components through exhaust passage 24 in the direction of arrow S shown in FIG. 2. These gaseous components then are sent to a gas analyzer, not shown, where the components are analyzed and their concentrations are determined.

Although in the above described and illustrated arrangement only the lower electrode 6 is rotatable, alternatively the upper electrode 19 may be made rotatable. Furthermore, both electrodes could be made rotatable, in which case however the two electrodes should be rotated in opposite directions about the vertical axis.

Furthermore, it is to be understood that samples other than metallic samples may be supplied to the crucible. For example, nonmetallic samples such as ceramic materials may be supplied.

Furthermore, the furnace of the present invention may be employed to remove deposits which may have accumulated on the contact surfaces of the upper and lower electrodes. Thus, a dummy crucible having the same shape as the crucible 27 may be provided with suitable polishing means such as abrasive papers or the like and may be positioned in the position shown by crucible 27 in FIG. 2. Operation of the actuator 4 then will result in polishing of the electrode surfaces and removal therefrom of any accumulated deposits, such as oxides.

As will be apparent from the above discussion, in accordance with the present invention, when the crucible and the upper and/or lower electrode are rotated after bringing the crucible into tight contact with respective electrode surfaces, the crucible surfaces are brought into intimate contact with the electrode surfaces due to the frictional forces produced during the rotation. This is true even though the respective contact surfaces between the electrodes and the crucible may be oxydized or stained with previous samples deposited thereon. Thus, the electrical contact between the crucible and the electrodes is improved. The crucible is brought into more intimate and electrically conductive contact with the electrode surfaces than prior to the rotation of the upper and/or lower electrodes. As a result, it is possible to achieve very good electric contact to a degree not possible in known furnaces, and without the need for troublesome and time consuming manual polishing operations. Thereby, it is possible to achieve a more accurate analysis of the gaseous components extracted. Furthermore, premature deterioration of the electrodes is prevented.

Although the present invention has been described and illustrated with regard to a preferred embodiment thereof, it is to be understood that various modifications and changes may be made without departing from the scope of the present invention.

We claim:

1. An extractive furnace for extracting gaseous components from material samples, which gaseous components are then to be analyzed, said furnace comprising:

upper and lower electrodes mounted to press therebetween a crucible of electrically conductive material, such that the application of an electric current to said electrodes will cause heating of a material sample adapted to be contained in the crucible, thereby extracting gaseous components from the material sample; and means rotating at least one of said upper and lower electrodes about a vertical axis, and thereby causing surfaces of the crucible contacting respective surfaces of said upper and lower electrodes to rotate under friction against said respective surfaces, thereby improving electrical contact between the crucible and said electrodes.

2. A furnace as claimed in claim 1, wherein said crucible comprises graphite crucible.

3. A furnace as claimed in claim 1, wherein said upper electrode is fixed, and said lower electrode is vertically movable.

4. A furnace as claimed in claim 3, further comprising an air cylinder having a movable rod connected to said lower electrode, thereby forming means vertically moving said lower electrode.

5. A furnace as claimed in claim 1, wherein said respective surfaces comprise a surface defined by a step in said upper electrode and an upper end surface of said lower electrode.

6. A furnace as claimed in claim 1, wherein said upper electrode is non-rotatably mounted, and said rotating means comprises a rotary actuator connected to said lower electrode rotating said lower electrode about said vertical axis.

7. A furnace as claimed in claim 1, wherein said rotating means comprises means rotating said upper and lower electrodes in opposite directions about said axis.

* * * * *